US006375581B1

(12) United States Patent
Urban et al.

(10) Patent No.: US 6,375,581 B1
(45) Date of Patent: Apr. 23, 2002

(54) INSTRUCTIONAL SWING DEVICE

(76) Inventors: James Michael Urban, 5211 Meadowcrest Dr., Pittsburgh, PA (US) 15236; Robert Joseph Dailey, 1098 Sarah St., Bethel Park, PA (US) 15102

( * ) Notice: Subject to any disclaimer, the term of this patent is extended or adjusted under 35 U.S.C. 154(b) by 0 days.

(21) Appl. No.: 09/644,356

(22) Filed: Aug. 23, 2000

Related U.S. Application Data

(60) Provisional application No. 60/150,370, filed on Aug. 23, 1999.

(51) Int. Cl.[7] ..... A63B 69/36

(52) U.S. Cl. ..... 473/215; 473/458; 473/453; 473/422; 473/266; 473/207

(58) Field of Search ..... 473/422, 451, 473/453, 458, 266, 207, 215, 216

(56) References Cited

U.S. PATENT DOCUMENTS

| | | | | | |
|---|---|---|---|---|---|
| 3,368,817 | A | | 2/1968 | Duncan | |
| 3,643,960 | A | | 2/1972 | Gentilly | |
| 3,808,707 | A | | 5/1974 | Fink | |
| 4,422,643 | A | | 12/1983 | Cushing | |
| 4,582,325 | A | * | 4/1986 | Yuhara | 473/215 |
| 4,895,373 | A | * | 1/1990 | Richmon | 473/215 |
| 5,092,601 | A | | 3/1992 | Rilling | |
| 5,118,104 | A | * | 6/1992 | DeLanzo | 473/458 |
| 5,337,758 | A | | 8/1994 | Moore et al. | |
| 5,354,050 | A | * | 10/1994 | McCarthy | 473/458 |
| 5,372,365 | A | | 12/1994 | McTeigue et al. | |
| 5,375,836 | A | * | 12/1994 | Kiser | 473/458 |
| 5,397,121 | A | | 3/1995 | Gipson et al. | |
| 5,443,266 | A | * | 8/1995 | Bursi | 473/215 |
| 5,511,789 | A | | 4/1996 | Nakamura | |
| 5,582,551 | A | | 12/1996 | Bursi | |
| 5,607,361 | A | | 3/1997 | Mastandrea et al. | |
| 5,640,719 | A | * | 6/1997 | Ritchie | 473/458 |
| 5,713,804 | A | * | 2/1998 | Socci et al. | 473/422 |

* cited by examiner

*Primary Examiner*—Raleigh W. Chiu
(74) *Attorney, Agent, or Firm*—Webb Ziesenheim Logsdon Orkin & Hanson, P.C.

(57) ABSTRACT

An instructional swing device for teaching the proper swing for baseball, golf or the like. The instructional swing device comprises a vest or harness arrangement which positions an adjustable, stretchable strap across the torso of the user from one shoulder to the opposite hip. Attached to the strap is an audible indicating mechanism, such as a buzzer, which is activated by proper movement of the user through stretching of the strap. In operation, the audible indicating mechanism identifies a proper swing during use to provide feedback to the user that the user is performing the desired hip movement in advance of the hands.

17 Claims, 2 Drawing Sheets

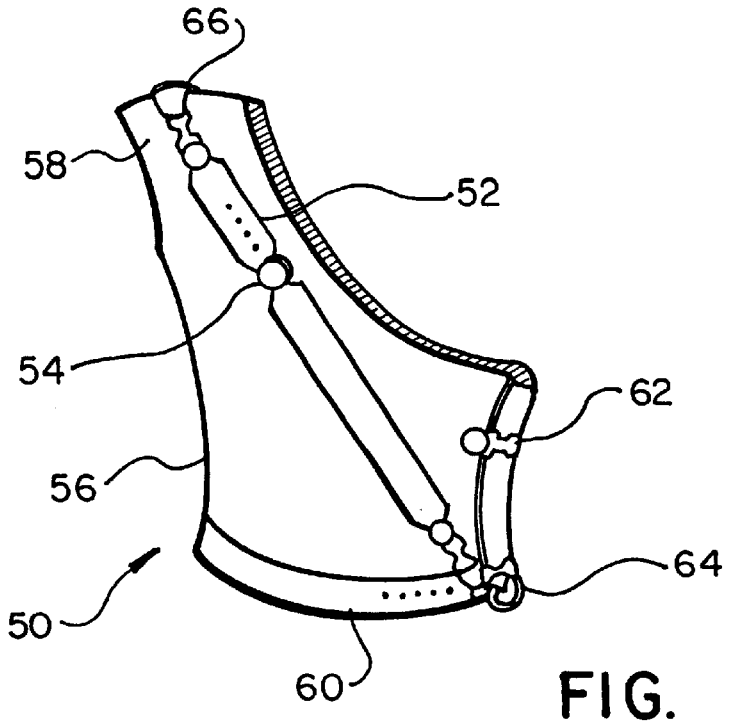
FIG. 3
FIG. 4
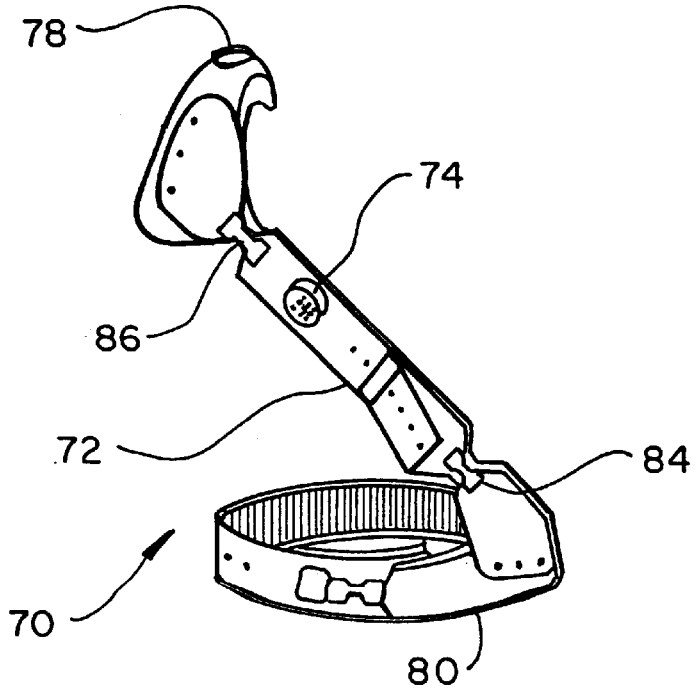

INSTRUCTIONAL SWING DEVICE

CROSS-REFERENCE TO RELATED APPLICATION

This application claims the benefit of earlier filed U.S. Provisional Patent Application Serial No. 60/150,370, filed Aug. 23, 1999 entitled "Instructional Swing Device," which in incorporated herein by reference in its entirety.

BACKGROUND OF THE INVENTION

1. Field of the Invention

The present invention relates to an instructional swing device for training users in proper sports swing technique. More particularly, the present invention relates to an instructional swing device to be worn by the user which does not inhibit the user's swing and which is instructive of proper swing technique for baseball or golf using audible feedback to the user.

2. Background Information

A variety of athletic training devices have been developed for assisting users in improving and perfecting particular sports movements, such as a baseball, golf or tennis swing. There is a large collection of sport swing instructional devices which are directed towards restrictive harnesses that limit improper movement and permit only a "proper swing". These restrictive harnesses do allow the user to become accustomed to the proper movements, but are not always effective since the user is not trained to perform the motion properly without the harness. Additionally, such harnesses do not always account for the timing or sequence of movements in a proper swing.

Passive (i.e., non-restraining) training devices have also been developed as instructional swing devices. For example, U.S. Pat. No. 5,582,551 to Bursi discloses a golf swing training device including a harness worn by the user which generates an audible signal during a proper swing. Specifically, the device includes an arm band with a protruding tab which is positioned to contact a corresponding tab on a strap attached to the user's waist during the execution of a proper swing to provide the audible feedback.

U.S. Pat. No. 5,511,789 to Nakamura discloses a golf swing training device which includes detectors detecting contact of the golfer's shoulder with the chin for identifying proper swing positioning as well as providing a detectable signal to the golfer in response to the sensed conditions.

U.S. Pat. No. 5,372,365 to McTeigue et al. teaches a sport training device which incorporates a plurality of sensors adjacent the user, such as under the user's feet and between the user's hands and the golf club, for generating signals corresponding to the user's movement. The sensors are used to develop training signals representing the relationship between the actual movement pattern and the desired movement pattern.

U.S. Pat. No. 5,337,758 to Moore et al. discloses a spine motion analyzer for developing sports techniques such as the swinging of a golf club, tennis racket, baseball bat or the throwing of a ball. The analyzer comprises a wearable harness formed of a linkage mechanism in which transducers are connected to various linkage arms to provide electronic signals indicative of the user's position throughout the swing.

U.S. Pat. No. 5,607,361 to Mastandrea et al. discloses a golf training aid which is positioned on the back of the golfer's hand to provide the golfer with an audible signal when the golfer's wrist has a selected angular orientation during critical portions of the golf club swing.

U.S. Pat. No. 3,808,707 to Fink discloses a physical training system which generates an audible signal during operation. It is intended that the audible signal be utilized as feedback for the user to allow the user to optimize his performance of a particular activity.

U.S. Pat. No. 3,643,960 to Gentilly discloses a golf training device which is intended to maintain the user's head in the down position throughout the swing. The golf training device includes a harness for attaching the device to the user's shoulder. Additionally, it includes a torso encircling strap to position the lower portion of the device.

In both baseball and golf, it is particularly advantageous for the user to have the proper hip rotation be performed in advance of the hands, since this results in maximum power. The above devices do not provide a simple, easily manufactured device for tracking or perfecting this motion for the user. Other known devices have concentrated on hip motion such as U.S. Pat. No. 3,368,817 to Duncan and U.S. Pat. No. 5,092,601 to Rilling.

The Duncan patent discloses a golf training device for monitoring a golfer's swing indicating when the golfer's swing is occurring properly. The device is intended to be clipped to the golfer's belt. When the swing is properly carried out, the device will illicite an audible click, which occurs at generally uniform intervals such that the golfer can readily tell when the swing has been properly carried out.

The Rilling patent discloses a pivot trainer for golfers which is worn by the golfer in proximity to the hips to monitor and train effective hip motion during the swing. The device includes a transducer having an electronically conducting, moveable element. In operation, if the hips are properly rotated and the golfer is pivoted properly, a variable element contacts the moveable element completing the circuit causing an audible feedback signal to issue from the device.

These existing devices do not provide a pivot training device which is cost-effective to manufacture and sufficiently reliable to provide an appropriate audible feedback to the user during the desired hip rotation of a proper swing. It is the object of the present invention to overcome the aforementioned drawbacks of the prior art. It is another object of the present invention to provide an instructional swing device, particularly for baseball or golf, which is easy to utilize.

SUMMARY OF THE INVENTION

The above objects are achieved with an instructional swing device according to the present invention. The present invention comprises a vest or harness arrangement which positions an adjustable, stretchable activating strap across the torso of the user from one shoulder to the opposite hip. Attached to the activating strap is an audible indicating mechanism, such as a buzzer, which is activated by proper movement of the user through stretching or pulling of the activating strap. In operation, the audible indicating mechanism identifies a proper swing during use to assure that the user is performing the desired hip movement in advance of the hands.

In at least one embodiment of the present invention, the harness or vest is provided with means for reversing the orientation of the activating strap, wherein the activating strap may be switched to extend between the opposite shoulder and hip to accommodate either right-handed or left-handed users. The vest may be formed with only a single shoulder portion. In the harness arrangement the harness may include a shoulder strap and a hip strap with the stretchable, activating strap extending therebetween.

These and other advantages of the present invention will be clarified in the detailed description of the preferred embodiments taken together with the attached figures wherein like reference numerals represent like elements throughout.

BRIEF DESCRIPTION OF THE DRAWINGS

FIG. 3 is a perspective view of an instructional swing device according to a third embodiment of the present invention; and FIG. 4 is a perspective view of an instructional swing device according to a fourth embodiment of the present invention.

DETAILED DESCRIPTION OF THE PREFERRED EMBODIMENTS

Figure 1:
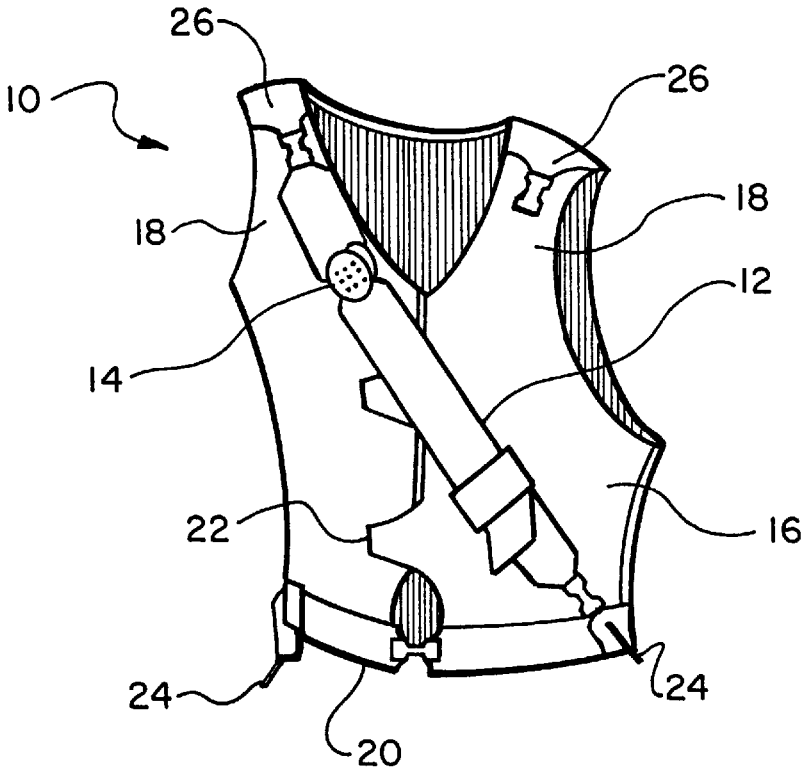
FIG. 1 is a perspective view of an instructional swing device according to a first embodiment of the present invention.

FIG. 1 illustrates an instructional swing device 10 according to a first embodiment of the present invention. The instructional swing device 10 is a passive training device in that it does not restrict the motion of the user. The instructional swing device 10 is particularly suited for baseball or golf and is primarily intended to give the user an audible feedback of proper hip rotation during a batting or golfing swing. The feedback is contemporaneous with the swing motion to provide proper feedback to the user.

The instructional swing device 10 includes an adjustable, stretchable activating strap 12 positioned across the torso of the user from one shoulder to the opposite hip. An audible indicating mechanism in the form of a buzzer 14 is attached to the activating strap 12. The buzzer 14 is attached to the activating strap 12 such that the buzzer 14 is activated by pulling or stretching of the activating strap 12 during a proper swing by the user. Specifically, an upper portion of the activating strap 12 may be secured to a housing of the buzzer 14 while the lower portion of the activating strap is attached to a switch for activating the buzzer 14 by pulling on the switch. This attachment of the buzzer 14 may also be reversed with the same operating effect.

A vest 16 is provided with a pair of shoulder panels or portions 18. The vest 16 includes an adjustable hip strap 20 encircling the hips of the user. The vest 16 further includes Velcro® closures 22, or other conventional fasteners, for securing the vest 16 on the user. A pair of clips 24 are provided on opposite sides of the hip strap 20 with each clip 24 adapted to releasably attach the activating strap 12 thereto. Each shoulder portion 18 includes a clip 26 which is adapted to releasably attach the activating strap 12 thereto. The two pairs of clips 24 and 26 provide for reversing the orientation of the activating strap 12, wherein the activating strap 12 may be switched to extend between the opposite shoulder and hip to accommodate either right-handed or left-handed users.

In operation, the instructional swing device 10 is easy to use. For example, in baseball, the user is fitted with the instructional swing device 10 with the activating strap 12 extending from the right shoulder to the left hip for a right-handed user or vice versa for a left-handed user. The user then performs the batting swing motion wearing the instructional swing device and the user is provided with simultaneous audible feedback during the swing indicative of proper hip rotation in advance of the hands. This is because the buzzer 14 is activated by stretching or pulling of the activating strap 12 during a proper swing by the user.

Figure 2:
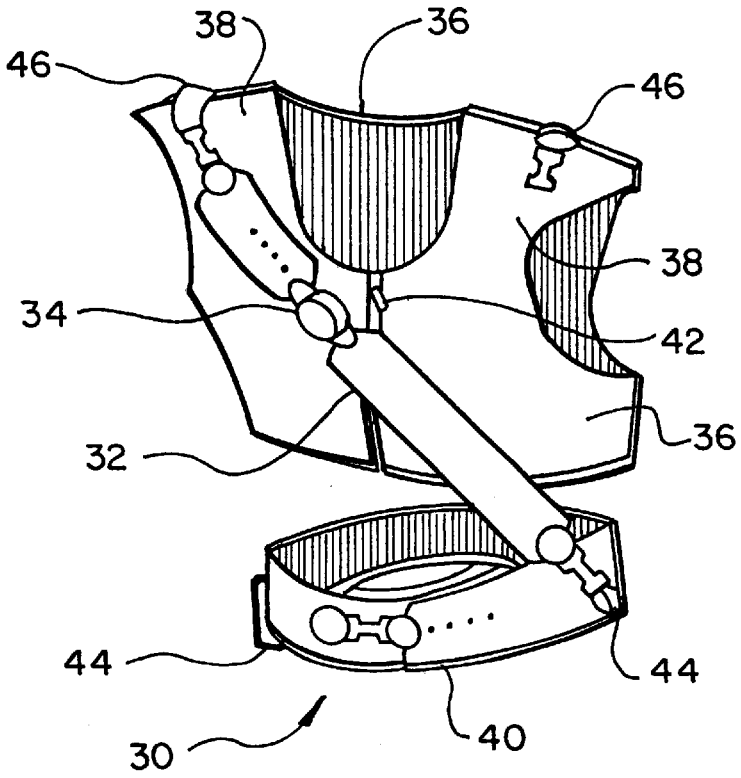
FIG. 2 is a perspective view of an instructional swing device according to a second embodiment of the present invention.

FIG. 2 illustrates an instructional swing device 30 according to a second embodiment of the present invention. The instructional swing device 30 is substantially the same as instructional swing device 10 and operates in the same manner. The instructional swing device 30 includes an adjustable, stretchable activating strap 32 positioned across the torso of the user from one shoulder to the opposite hip. A buzzer 34 is attached to the activating strap 32 such that the buzzer 34 is activated by pulling or stretching of the activating strap 32 during a proper swing. The activating strap 32 provides a different adjustment mechanism from adjustment strap 12, as shown in the figures. Additionally, the buzzer 34 is attached to the activating strap 32 in a slightly different manner than the buzzer 14, as shown in the figures. These distinctions are intended to show some of the various modifications which can be easily made in the present design within the scope of the present invention.

A vest 36 is provided with a pair of shoulder panels or portions 38. An adjustable hip strap 40 is provided encircling the hips of the user, with the hip strap 40 separate from the vest 36. The vest 36 further includes a zipper 42 for securing the vest 36 on the user. A pair of clips 44 are provided on opposite sides of the hip strap 40 with each clip 44 adapted to releasably attach the activating strap 32 thereto. Each shoulder portion 38 includes a clip 46 which is adapted to releasably attach the activating strap 32 thereto. The two pairs of clips 44 and 46 provide for reversing the orientation of the activating strap 42 in the same manner as clips 24 and 26 discussed above.

FIG. 3 illustrates an instructional swing device 50 according to a third embodiment of the present invention. The instructional swing device 50 is similar to instructional swing devices 10 and 30 and operates in substantially the same manner. The instructional swing device 50 includes an adjustable, stretchable activating strap 52 positioned across the torso of the user and a buzzer 54 attached to the activating strap 52, with the buzzer 54 activated by pulling or stretching of the activating strap 52 during a proper swing motion. A vest 56 is provided with a single shoulder portion 58 and an adjustable hip strap 60 encircling the hips of the user. The vest 56 further includes a buckle 62 for securing the vest 56 on the user. A reversible clip 64 is provided on one side of the hip strap 60 and is adapted to releasably attach the activating strap 52 thereto. The shoulder portion 58 includes a reversible clip 66 which is adapted to releasably attach the activating strap 52 thereto. The reversing clips 64 and 66 and reversing vest 56 provide for reversing the orientation of the activating strap 52. In this embodiment, the reversible vest 56 is placed on the user with the shoulder portion 58 over the desired shoulder of the user. In order to reverse the vest 56, the front and back panels of the vest are reversed (i.e., essentially the vest 56 is pivoted 180 degrees about the user). The reversible clips 64 and 66 will be positioned toward the forward facing portion of the vest 56.

FIG. 4 illustrates an instructional swing device 70 according to a fourth embodiment of the present invention. The instructional swing device 70 is similar to instructional swing devices 10, 30 and 50 and operates in substantially the same manner. The instructional swing device 70 includes an adjustable, stretchable activating strap 72 positioned across the torso of the user and a buzzer 74 is attached to the activating strap 72, with the buzzer 74 activated by pulling or stretching of the activating strap 72 during a proper swing motion. The instructional swing device 70 is different from the previously described embodiments in that a vest is not provided. A single reversible shoulder strap 78 is provided with an adjustable hip strap 80 encircling the hips of the user. The shoulder strap 78 and the hip strap 80 combine to form a support harness for the activating strap 72. A clip 84 is releasably attached to one side of the hip strap 80 and is adapted to releasably attach the activating strap 72 thereto. The shoulder strap 78 includes a clip 86 which is adapted to releasably attach the activating strap 72 thereto. The reversible shoulder strap 78 and the removably attached clip 84 provide for reversing the orientation of the activating strap 72. In this embodiment, the reversible shoulder strap 78 is placed over the desired shoulder of the user and the clip 84 is attached to the opposite side of the hip strap 80 by buttons or the like.

Various changes may be made to the present invention without departing from the spirit and scope thereof. For example, while the present invention is particularly suited for baseball and golf, it may have other applications in other sports such as tennis, racquetball or the like. Consequently, the above embodiments are intended to be illustrative of the present invention and not restrictive thereof. The scope of the present invention is defined by the appended claims and equivalents thereto.

What is claimed is:

1. An instructional swing device comprising:

an adjustable, stretchable activating strap adapted to be positioned across the torso of the user extending from one shoulder to the opposite hip;

an audible indicating mechanism attached to said activating strap, wherein said audible indicating mechanism is activated by stretching of said activating strap during a proper swing by the user.

2. The instructional swing device of claim 1 further including an adjustable hip strap encircling the hips of the user, wherein said activating strap is attached to said hip strap.

3. The instructional swing device of claim 2 further including an adjustable shoulder strap, wherein said activating strap is attached to said shoulder strap, and wherein said shoulder strap and said hip strap form a harness for supporting said activating strap.

4. The instructional swing device of claim 1 further including means for reversing the orientation of said activating strap, wherein said activating strap may be switched to extend between the opposite shoulder and hip to accommodate either right-handed or left-handed users.

5. The instructional swing device of claim 1 further including a vest having at least one shoulder portion, wherein said activating strap is releasably attached to one said shoulder portion.

6. The instructional swing device of claim 5 wherein said vest has two shoulder portions with a clip on each said shoulder portion for releasably attaching said activating strap thereto.

7. The instructional swing device of claim 5 further including an adjustable hip strap encircling the hips of the user, wherein said activating strap is releasably attached to said hip strap.

8. The instructional swing device of claim 7 wherein said hip strap includes a pair of clips on opposite sides of said hip strap, each said clip adapted to releasably attach said activating strap thereto.

9. The instructional swing device of claim 8 wherein said vest has two shoulder portions with a clip on each said shoulder portion for releasably attaching said activating strap thereto.

10. A passive instructional swing device for indicating proper hip rotation during a swing, said device comprising:

an adjustable, stretchable activating strap adapted to be positioned across the torso of the user from one shoulder of the user to the opposite hip of the user;

an audible indicating mechanism attached to said activating strap, wherein said audible indicating mechanism is activated by pulling of said activating strap during a proper swing by the user;

an adjustable hip strap encircling the hips of the user;

at least one releasable connection on said hip strap for releasably attaching said activating strap thereto; and at least one releasable connection positioned on a shoulder of the user for releasably attaching said activating strap thereto.

11. The instructional swing device of claim 10 further including an adjustable shoulder strap, wherein said releasable connection positioned on a shoulder of the user is attached to said shoulder strap, and wherein said shoulder strap and said hip strap form a harness for supporting said activating strap.

12. The instructional swing device of claim 10 wherein said hip strap includes one said releasable connection on each side of said hip strap, each said releasable connection adapted to releasably attach said activating strap thereto such that said activating strap may be switched to extend between the opposite shoulder and hip to accommodate either right-handed or left-handed users.

13. The instructional swing device of claim 10 further including a vest having at least one shoulder portion, wherein said releasable connection positioned on a shoulder of the user is attached to one said shoulder portion.

14. The instructional swing device of claim 13 wherein said vest has two said shoulder portions with one said releasable connection on each said shoulder portion for releasably attaching said activating strap thereto.

15. The instructional swing device of claim 10 wherein said audible indicating mechanism is a buzzer which is activated by said activating strap.

16. A method of training a user in a proper swing technique comprising the steps of:

a) fitting the user with an instructional swing device having an adjustable, stretchable activating strap adapted to be positioned across the torso of the user from one shoulder of the user to the opposite hip of the user, and an audible indicating mechanism attached to said activating strap;

b) having the user perform the swing motion wearing said instructional swing device; and c) providing simultaneous audible feedback to the user during the swing indicative of proper swing, wherein said audible indicating mechanism is activated by stretching of said activating strap during a proper swing by the user to produce said audible feedback.

17. The method of claim 16 wherein said swing is a baseball batting swing.

* * * * *